US007064257B2

(12) United States Patent
Victorine

(10) Patent No.: US 7,064,257 B2
(45) Date of Patent: Jun. 20, 2006

(54) VICTOR GRAND PIANO PINBLOCK EXTRACTOR

(76) Inventor: Harry Malon Victorine, 2322 Avenham Ave., Roanoke, VA (US) 24014

( * ) Notice: Subject to any disclaimer, the term of this patent is extended or adjusted under 35 U.S.C. 154(b) by 0 days.

(21) Appl. No.: 10/709,207

(22) Filed: Apr. 21, 2004

(65) Prior Publication Data

US 2005/0235802 A1 Oct. 27, 2005

(51) Int. Cl.
*G10C 3/10* (2006.01)

(52) U.S. Cl. ..... 84/200

(58) Field of Classification Search ..... 84/200, 84/202; 156/344, 584; 29/40.23, 426.2, 29/426.4, 426.5
See application file for complete search history.

(56) References Cited

U.S. PATENT DOCUMENTS 5,012,705 A * 5/1991 Chow ..... 81/63
6,138,537 A * 10/2000 Cole ..... 81/439
6,584,662 B1 * 7/2003 Krick ..... 29/263

* cited by examiner

*Primary Examiner*—Kimberly Lockett
(74) *Attorney, Agent, or Firm*—Merek, Blackmon & Voorhees, LLC

(57) ABSTRACT

A device and method for removing a pinblock from a grand piano wherein the pinblock is installed in the piano case by means of wooden dowels and a glue joint between the edges of the pinblock and the inside surface of the case by creating sufficient lateral force between the two parts to fracture the glue joint and withdraw the blind wooden dowels from the case.

11 Claims, 3 Drawing Sheets

VICTOR GRAND PIANO PINBLOCK EXTRACTOR

BACKGROUND OF INVENTION

The tuning pins in a grand piano are installed in a laminated plank called a pinblock or wrestplank which is located beneath the large cast iron harp. Herein, it will be called a pinblock.

For more than a hundred years, some manufacturers of grand pianos have installed the pinblocks in the piano cases with wooden dowels, shims and glue along three sides and bottom of the pinblock, making it an integral part of the case.

Over a period of time the pinblocks will wear and otherwise deteriorate to a point where they will no longer securely hold the tuning pins and the pinblock will have to be replaced.

The known methods of removing the old blocks involve the use of hammers, chisels, saws of various sorts and electric routers. All of these methods are time consuming, uncontrollable and often result in residual damage to the finished parts of the cases.

SUMMARY OF INVENTION

The inventions are a device and method for removing a pinblock from a grand piano wherein the pinblock is installed in the piano case by means of wooden dowels and a glue joint between the edges of the pinblock and the inside surface of the case by creating sufficient lateral force between the two parts to fracture the glue joint and withdraw the blind wooden dowels from the case.

Figure 1:
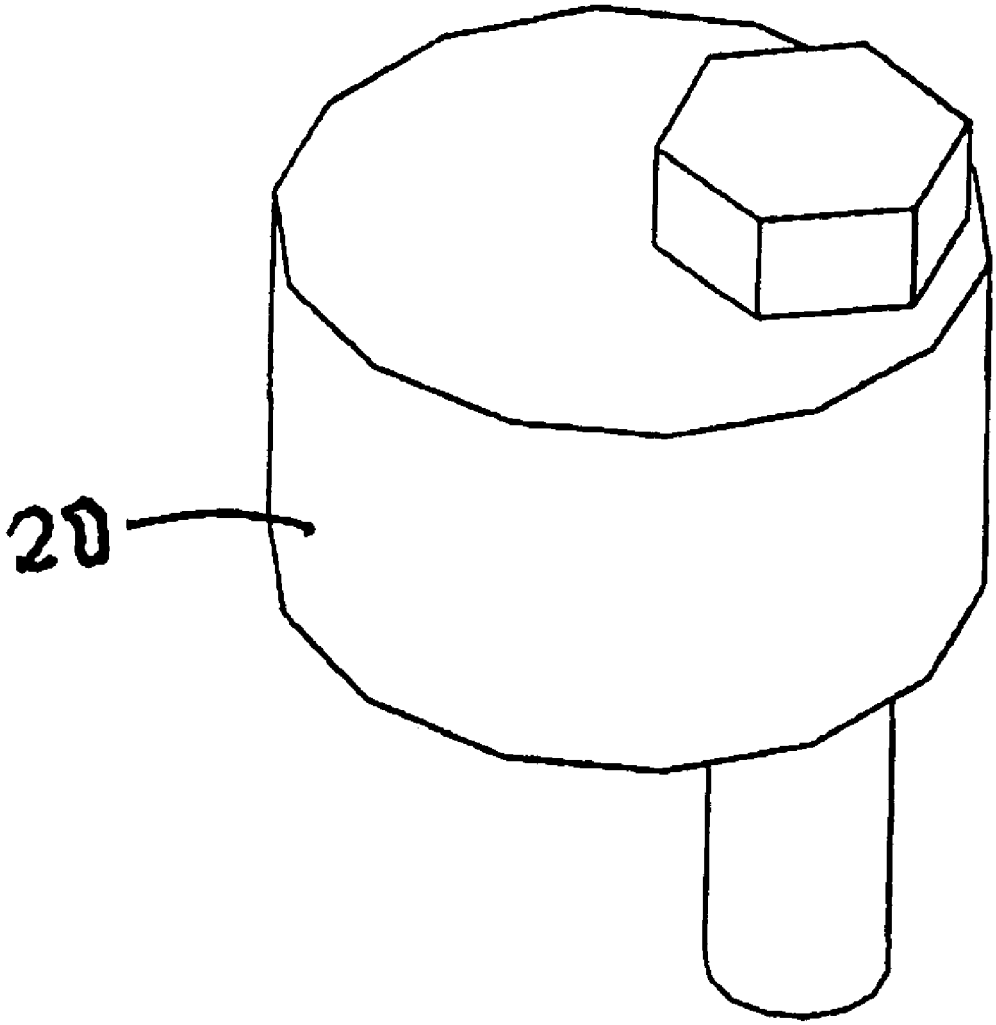
FIG. 1 View of assembled invention.

Now with reference to FIG. 1 an assembled tool 20 is shown.

Figure 2:
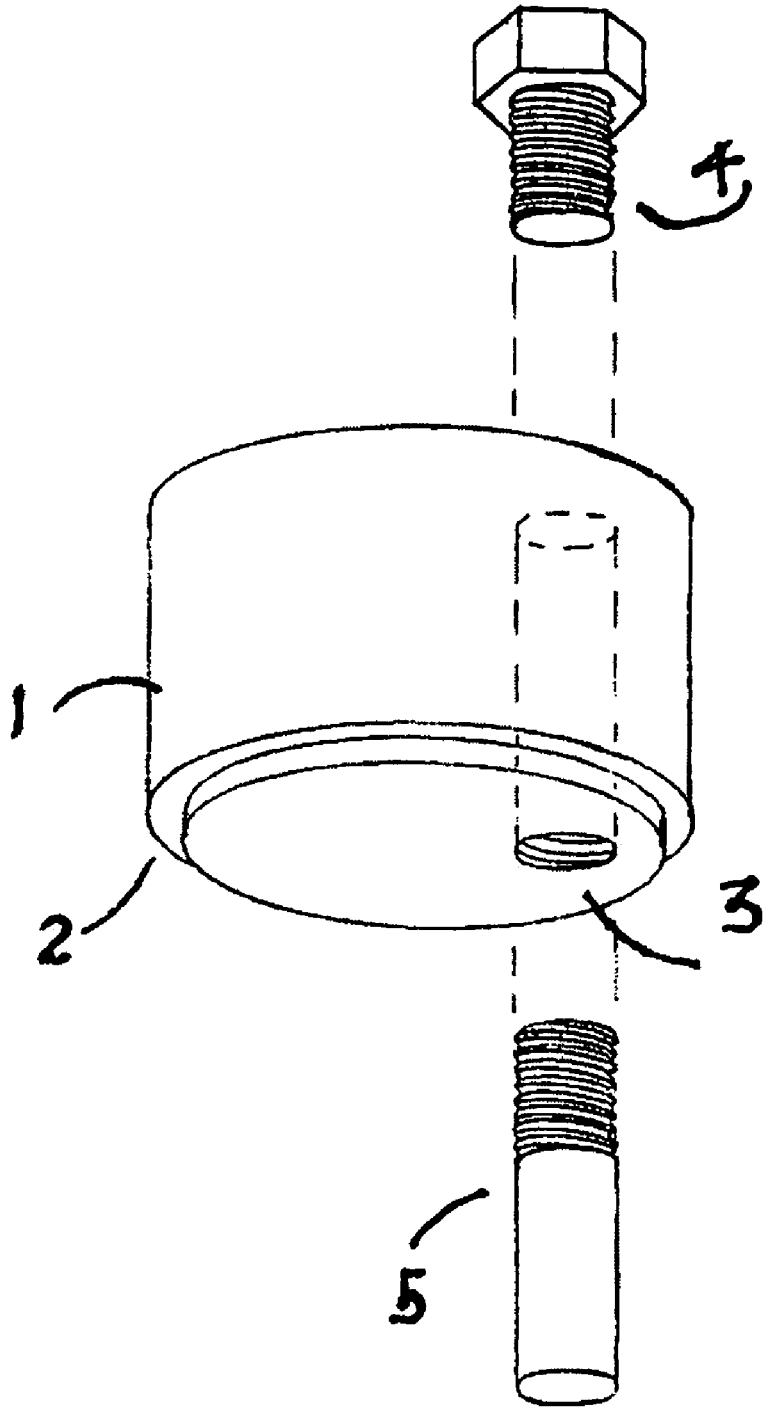
FIG. 2 Exploded view of the invention identifying the component parts.

Referring to FIG. 2, the tool 20 includes a cylinder 1 and shaft 5, which are each preferably tooled from a single piece of steel, and hex-head machine screw 4. Cylinder 1 includes notch 2 machined in the bottom and hole 3 drilled through from top to bottom and offset from its center. Shaft 5 is cylindrical in shape and is threaded for a length on one end. Hole 3 is threaded for a length at top and bottom to receive machine screw 4 at top and shaft 5 at bottom.

When assembled and deployed the invention is rotated one half turn as a monolithic device by a wrench (not shown) applied to machine screw 4.

While the dimensions of the elements are not critical, the shaft should be of sufficient diameter to withstand an axial and lateral force of up to sixty foot-pounds of torque applied to machine screw 4.

Cylinder 1 should be of sufficient diameter to displace laterally upon rotation up to 1.5 inches when hole 3 is offset approximately ½ inch from its center. Cylinder 1 should be of sufficient height to absorb the lateral force on case 10 with a minimum of indentation.

In this embodiment of the device, cylinder 1 is approximately 2.5 inches in diameter and 2 inches in height, and shaft 5 is ⅝ inches in diameter and 3 inches in length. Machine screw 4 is ⅝ in diameter and ¾ inches in length. Notch 2 is 3/163/16 inches and allows full contact between the perimeter of cylinder 1 and case 10 in those instances when a wooden shim installed between pinblock 9 and case 10 extends slightly above the glue joint. The shim is not illustrated in this embodiment but will be obvious to one skilled is this art.

Figure 3:
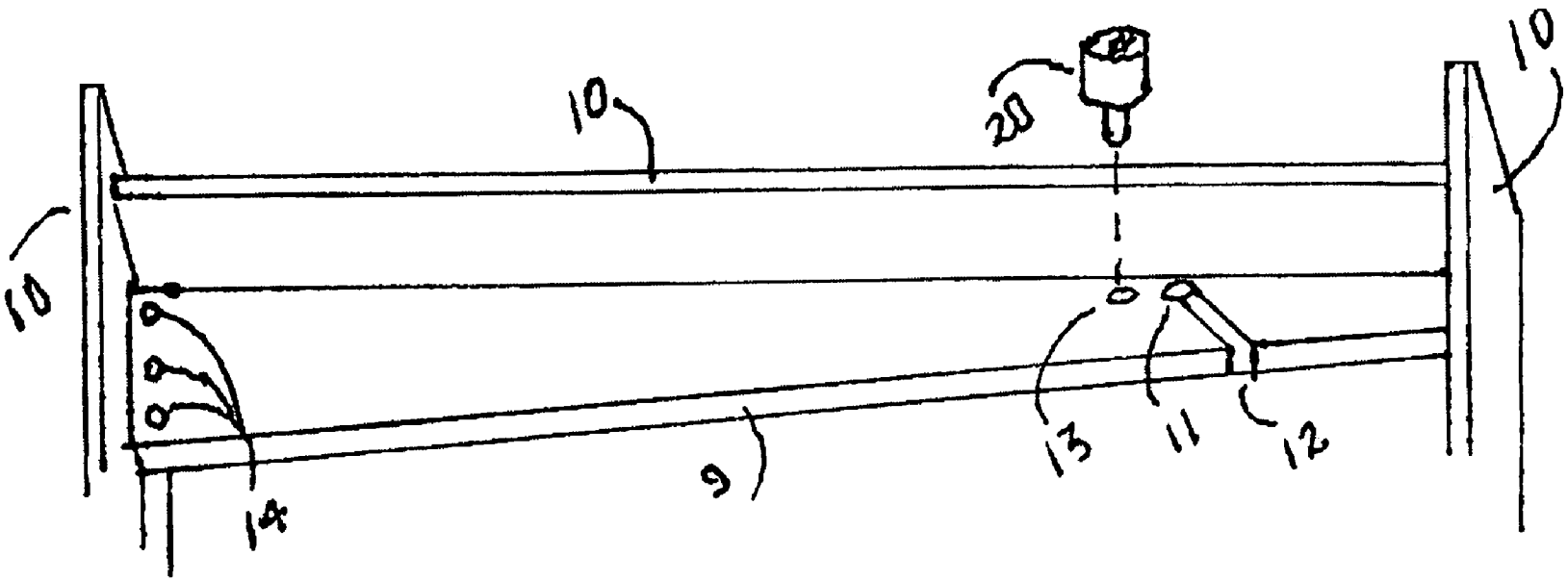
FIG. 3 Drawing showing preparation of pin block and deployment of device.

Referring to FIG. 3, pinblock 9 of the piano must be prepared to receive the invention as illustrated. In this embodiment of the invention, perpendicular hole 11, of sufficient diameter to accept the blade of a saber saw, is drilled in pinblock 9 approximately 8 inches from its smaller end and flush with case 10. Saw cut 12 is made in pinblock 9 from hole 11 along an angle toward the smaller end to exit at the exposed edge. Hole 13, ⅝ in diameter, is drilled on a center ⅞ inch from case 10 and about two inches from the long side of saw cut 12. Vertical dowels 14 in each end of pinblock 9 are drilled out to allow lateral movement of pinblock 9 when the glue joint is fractured. Blind dowels are not illustrated in FIG. 3 since their removal is coincidental with the fracture of the glue joint.

Shaft 5 is fully inserted in hole 13 in pinblock 9. An appropriate wrench is applied to shaft-head 6 and rotated to a maximum of one half turn. The lateral force exerted between shaft 5 in pinblock 9 and the perimeter of cylinder 1 on case 10 will fracture the glue joint along its entire length between pinblock 9 and case 10 and will withdraw the blind dowels (not shown) between the front edge of pin block 9 and case 10. Pinblock 9 may now be lifted from the case.

The invention claimed is:

1. A tool for removing a pinblock from a piano case comprising;

a) a cylinder having a first face and a second face and an outer perimeter and a central axis, said outer perimeter surrounding said central axis;

b) said cylinder having a first shaft extending outwardly from said first face of said cylinder parallel to and offset from said central axis;

c) said cylinder having a second shaft extending outwardly from said second face of said cylinder parallel to and offset from said central axis;

d) said first shaft includes a head thereon for receipt of a wrench;

e) whereby, upon insertion of said second shaft into a hole in a pinblock and then rotating said cylinder through the use of a wrench applied to said head a lateral force can be applied to a piano case through the outer perimeter of said cylinder and thereby breaking a glue joint between the piano case and the pinblock.

2. The tool as set forth in claim 1,wherein:

a) said first shaft and said second shaft are coaxial.

3. The tool as set forth in claim 1, wherein:

a) said cylinder is circular.

4. The tool as set forth in claim 1, wherein:

a) said cylinder is at least two inches in diameter.

5. The tool as set forth in claim 1, wherein:

a) said first shaft is offset from said central axis at least ½ inch.

6. A method of removing a pinblock from a piano comprising the steps of:

a) drilling out at least one dowel holding the pinblock in position;

b) drilling a hole perpendicular to the surface of the pinblock near a glue joint for receiving a glue joint fracture tool;

c) inserting a portion of said glue joint fracture tool into said hole, and;

d) rotating said glue joint fracture tool to separate the pinblock from the piano case.

7. The method as set forth in claim 6, wherein:

a) said glue joint fracture tool includes a cylindrical portion having a diameter, and b) drilling said hole includes placement of said hole at a location spaced from said glue joint a distance less than one half the diameter of said glue joint fracture tool.

8. The method as set forth in claim 6, wherein:

a) said glue joint fracture tool includes a cylinder having an outer perimeter and a central axis, said outer perimeter surrounding said central axis;

b) said cylinder having a first shaft extending outwardly from a first face of said cylinder parallel to and offset from said central axis;

c) said cylinder having a second shaft extending outwardly from a second face of said cylinder parallel to and offset from said central axis.

9. The method as set forth in claim 8, wherein:

a) said first shaft includes a head thereon for receipt of a wrench.

10. The method as set forth in claim 9, wherein:

a) said first shaft and said second shaft are coaxial.

11. The method as set forth in claim 10, wherein:

a) said cylinder is circular.

* * * * *